United States Patent [101]

Murzin et al.

[11] 4,052,873

[45] Oct. 11, 1977

[54] APPARATUS FOR CONTINUOUS PRESSING OF BOLTS, SCREW BLANKS OR SIMILAR PARTS

[75] Inventors: Horst Murzin; Günter Grygo, both of Karl-Marx-Stadt, Germany

[73] Assignee: Veb Schraubenkombinat, Karl-Marx-Stadt, Germany

[21] Appl. No.: 702,862

[22] Filed: July 6, 1976

[30] Foreign Application Priority Data

July 3, 1975 Germany ..... 187060

[51] Int. Cl.[2] ..... B21J 9/18

[52] U.S. Cl. ..... 72/185; 72/187; 72/190; 72/339

[58] Field of Search ..... 72/185, 187, 190, 191, 72/339; 10/13

[56] References Cited

U.S. PATENT DOCUMENTS

| | | | |
|---|---|---|---|
| 3,239,912 | 3/1966 | Baumgartner et al. | 72/185 |
| 3,359,774 | 12/1967 | Bouchard et al. | 72/339 |

*Primary Examiner*—Lowell A. Larson
*Attorney, Agent, or Firm*—Michael J. Striker

[57] ABSTRACT

Apparatus for shearing blanks from elongated workpieces and for pressing such blanks into screw blanks, bolts or the like in a continuous operation comprises a plurality of preferably cylindrical rotary elements, rotatable about parallel axes in such a manner that cooperating pairs of rotatable elements are rotated in opposite direction and so that blank receiving members on the rotary elements of each cooperating pair becomes successively aligned with each other. The plurality of rotary elements includes a central rotary element receiving sheared-off blanks and retaining the same during the pressing thereof until the final discharge, and a plurality of additional rotary elements arranged about the circumference of the central rotary element. One of the additional rotary elements serves to shear off blanks from the elongated workpieces and to transfer such blanks to the central rotary element and at least two further rotary elements cooperate with the central rotary element for forming the blanks through pressing.

7 Claims, 9 Drawing Figures

APPARATUS FOR CONTINUOUS PRESSING OF BOLTS, SCREW BLANKS OR SIMILAR PARTS

BACKGROUND OF THE INVENTION

The present invention relates to an apparatus for continuous pressing of bolts, screw blanks or similar parts from elongated workpieces, for instance a wire, in which an automatic, continuous working process from the feeding of the wire to the discharge of the pressed parts is obtainable.

Apparatus for the continuous production of workpieces from blanks cut off from elongated rod-shaped material, for instance by forging, are known in the art. The necessary stroke for the forming of the blanks is realized in this known construction by elements rotating in opposite directions.

A known apparatus for the production of nails comprises on the circumference of two rolls a great number of individual punches movable through a predetermined distance in the direction of the circumference of the rolls, of which two at any instant cooperating punches are moved at a speed greater than the circumferential speed of the rolls in forward direction at the moment in which the head of the nail is to be formed. Due to the relative movement between punch and rotary element a gap for receiving nail heads is formed in the region of approach of the rolls to each other.

In a further known apparatus for continuous cold pressing of parts, especially balls, the necessary press forms are tiltably mounted on rotary elements and the movement of the press forms relative to the rotary elements is controlled by two stationary cams. The cams determine by projection and depression thereon movement of the pressing tools.

The known, above briefly-described apparatus have, as compared with apparatus carrying out linear oscillating main movements, the advantage of a greater output, but these known apparatus are not suitable for production of complicated parts such as screw blanks which require a discharge stroke. In addition, in these known apparatus in which only a pair of rotary elements is provided, there is only one forming process possible and the application of such an apparatus is therefore limited.

SUMMARY OF THE INVENTION

It is an object of the present invention to provide an apparatus for continuous pressing of relatively complicated parts, which apparatus can be automatically and continuously operated from the feeding of a wire to the discharge of the formed parts and which comprises a plurality of continuously rotating elements for shearing off blanks from a continuous wire and for forming such blanks in a plurality of forming operations into a finished or semi-finished product.

It is a further object of the present invention to provide an apparatus of the aforementioned kind for the continuous pressing of bolts, screw blanks or similar parts of relatively short shank which are formed by a plurality of press-forming operations.

With these and other objects in view, which will become apparent as the description proceeds, the apparatus for shearing blanks from elongated rod-shaped workpieces and for pressing such blanks into bolts, screw blanks or the like in a continuous operation, mainly comprises a plurality of rotary elements arranged closely adjacent each other rotatable about parallel axes, in which each of the rotary elements is provided in the region of its periphery with blank receiving means and in which the rotary elements cooperate in pairs with each other and include a central rotary element, the blank receiving means of which are receiving blanks after the latter are sheared off and maintain the blanks during the pressing thereof until the final discharge of the formed article, and a plurality of additional rotary elements arranged about the circumference of the central rotary elements, in which one of the additional rotary elements serves to shear blanks from elongated rod-shaped workpieces and to transfer such blanks to the blank receiving means of the central element, whereas two additional rotary elements serve for partly forming such blanks. The rotary elements are driven by drive means about their axes in such a manner that the rotary elements of cooperating pairs are respectively driven in opposite directions and so that the blank receiving means on one rotary element of each pair will become successively aligned with corresponding blank receiving means of the other rotary element of the respective pair. The apparatus includes further means coordinated with the blank receiving means of the rotary elements for shearing blanks from elongated rod-shaped workpieces, for transferring such blanks from the one additional rotary element to the central element, for pressing the blanks and for discharging the blanks after pressing.

The apparatus includes further feeding means for feeding elongated workpieces towards the periphery of the one additional element and a stationary shearing tool arranged at a predetermined angle displaced in the direction of rotation of the one additional rotary element from a horizontal plane passing through the axis of rotation of said additional rotary element.

Each of the blank receiving means comprises a member formed with a passage extending in substantial radial direction for receiving a blank and this member is mounted in the respective rotary element tiltable about a tilting axis radially outwardly spaced from and parallel to the axis of rotation of the rotary element, and including means for tilting each member through a predetermined angle about this tilting axis to maintain the passages in a pair of cooperating rotary elements aligned with each other during rotation of the cooperating rotary elements through a given angle with respect to each other. The means for tilting the members about the tilting axis preferably comprise a lever connected to each of the members for tilting movement therewith and having a pair of arms projecting to opposite sides of the tilting axis, a pair of stationary cams, and a pair of roller followers mounted on the arms and respectively engaging the cams.

The apparatus further includes means cooperating with each of the members for applying a force in radial outward direction on a blank received in the passage of the respective member during part of the movement of the respective member with the respective rotary element about the axis of the latter. Each of these force applying means comprises a tilting arm connected to the respective member for tilting therewith about said tilting axis and projecting with an end thereof from the tilting axis toward the axis of rotation of the respective rotary member, a double-armed lever tiltably mounted on the free end of the tilting arm, a pushrod axially movable in the passage of the respective member engaged at one end thereof by one end of the double-armed lever and adapted to engage with the other end thereof a blank located in the passage, and an additional lever connected to the respective rotary element for rotation therewith and for tilting about an axis spaced from and parallel to said tilting axis, in which the additional lever has an abutment portion in engagement with the other end of the double-armed lever, a roller-follower mounted on said additional lever, and at least one additional stationary cam for each of said rotary elements engaged by the roller follower on the additional lever.

The advantage of the apparatus according to the present invention, as compared with similar apparatus known in the art, is that relatively complicated parts such as screws or similar parts, especially parts with a relatively short shank can be produced in a continuous process with a considerable increased output of the machine, as compared with such machines known in the art.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

DESCRIPTION OF THE PREFERRED EMBODIMENTS

Figure 1:
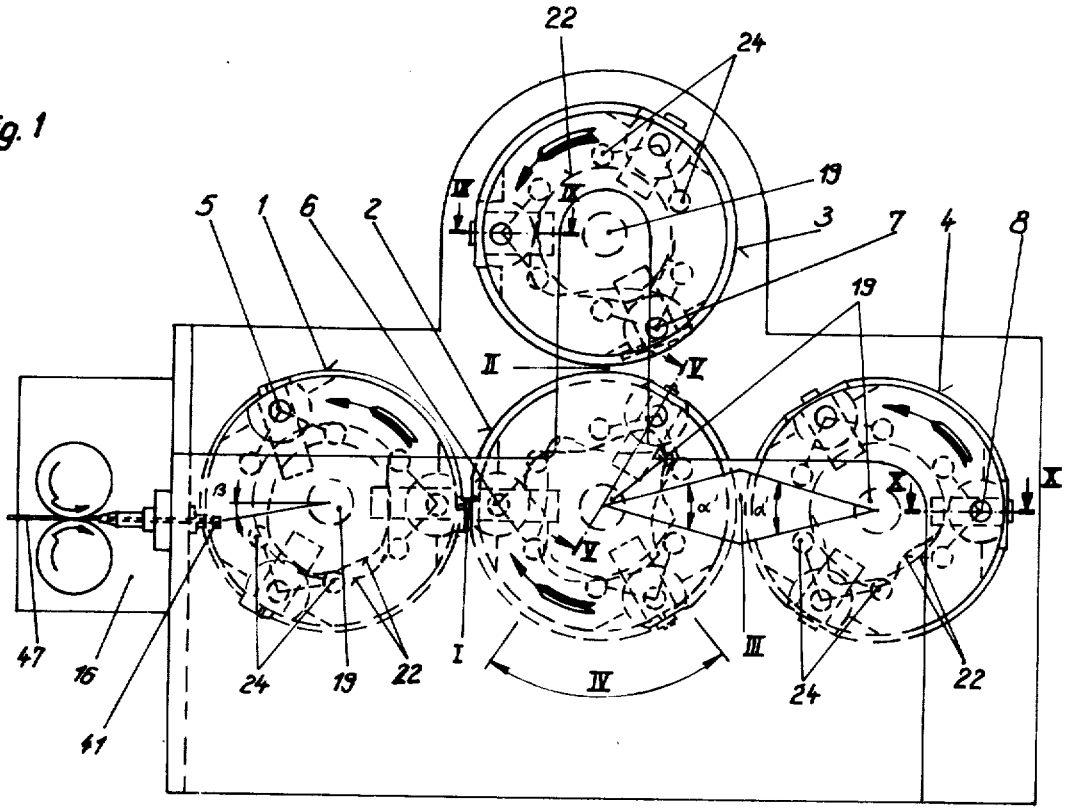
FIG. 1 is a schematic side view of the apparatus according to the present invention.

Referring now to the drawing it will be seen that the apparatus according to the present invention comprises four rotary elements 1, 2, 3 and 4 arranged adjacent each other and rotatable about parallel axes, in which the axes of the rotary elements 1, 2 and 4 are located in a horizontal plane, whereas the axis of the rotary element 3 is located in a vertical plane including the axis of the rotary element 2. The four rotary elements 1–4 are of subtantially cylindrical shape and preferably of the same diameter. Each of the rotary elements 1, 2, 3 and 4 is provided with three blank receiving members referred to respectively with the reference numerals 5, 6, 7 and 8, which are respectively uniformly spaced from each other on the respective rotary element. The work receiving members 5 of the rotary element 1 are provided with shearing tools, whereas the blank receiving means 6 of the central rotary member 2, about the circumference of which the additional rotary elements 1, 3 and 4 are arranged, are provided with matrices 9. The blank receiving means 7 of rotary element 3 are provided with prepressing tools and the blank receiving means 8 of the rotary element 4 are provided with finish pressing tools, not shown in the drawing. The matrices 9 of the central rotary elements serve to receive between the same the shank of the blank to be pressed.

Figure 2:
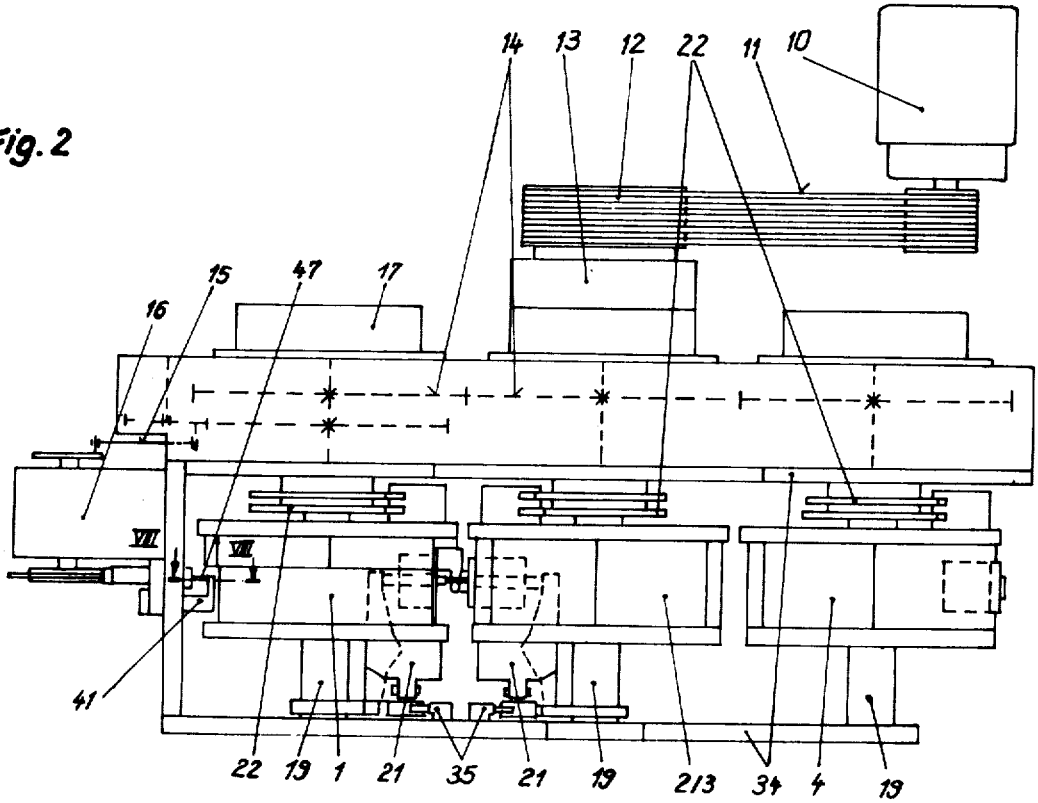
FIG. 2 is a schematic top view of the apparatus shown in FIG. 1.

The rotary elements 1–4 are driven for rotation about their axes by means of a stepless adjustable drive motor 10, which transmits rotation by V-belts 11 onto a flywheel 12, and rotation of this flywheel 12 is transmitted by means of a coupling 13 and corresponding gear drives 14 to the rotary elements 1–4, as best shown in FIG. 2. A crank drive 15, cooperating with the aforementined gear drive, serves in a known manner as drive element for a wire straightening and feeding device 16, which feeds the wire toward the periphery of the rotary element 1. Brakes 17 are provided for braking the rotating masses of the rotary elements 1–4.

Figure 5:
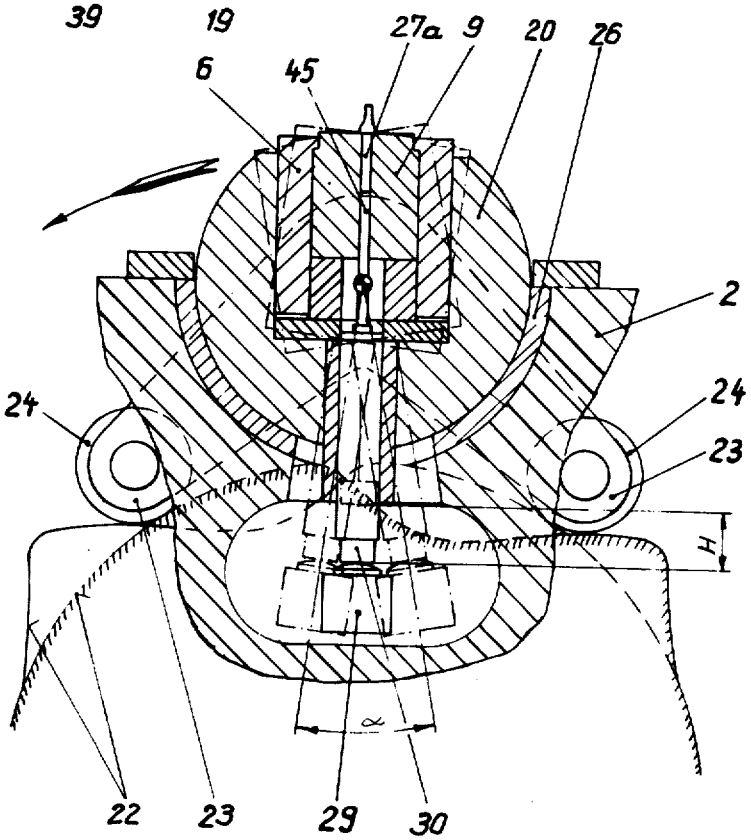
FIG. 5 is a cross-section taken along the line C—C of FIG. 3.
Figure 6:
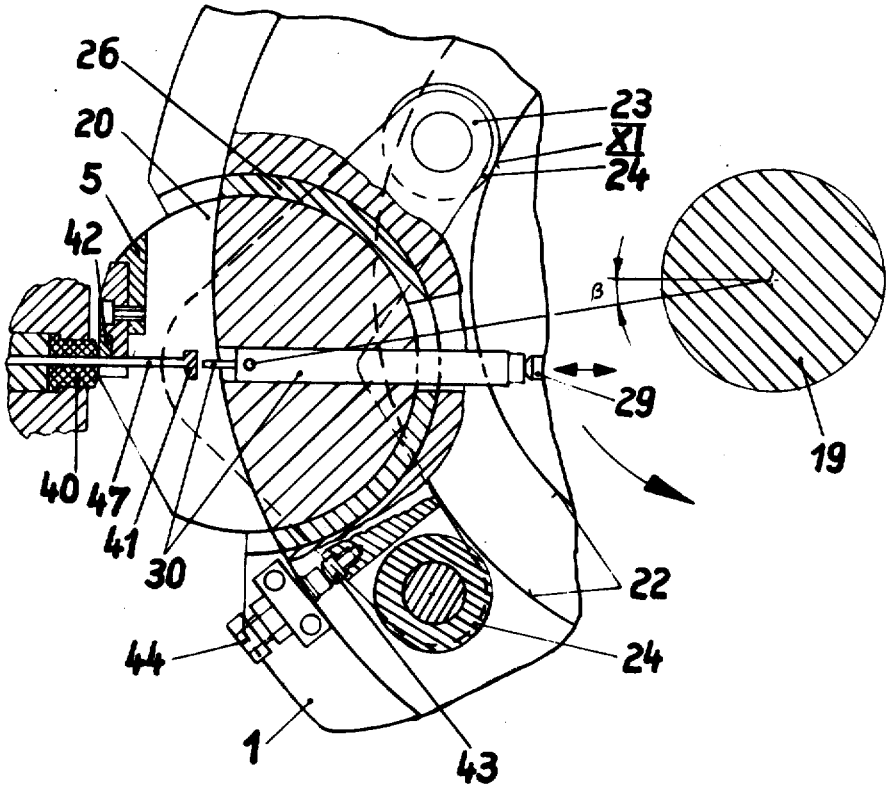
FIGS. 6–9 illustrate further features of the present invention.
Figure 7:
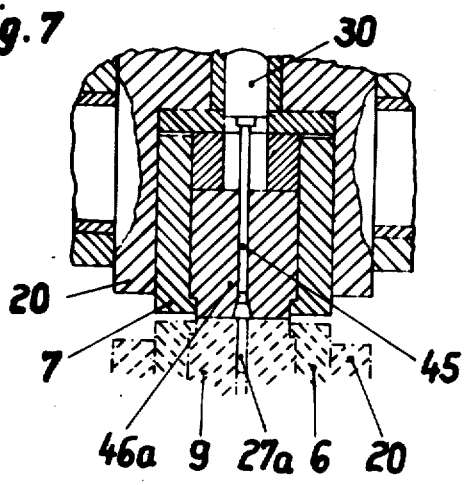
Figure 8:
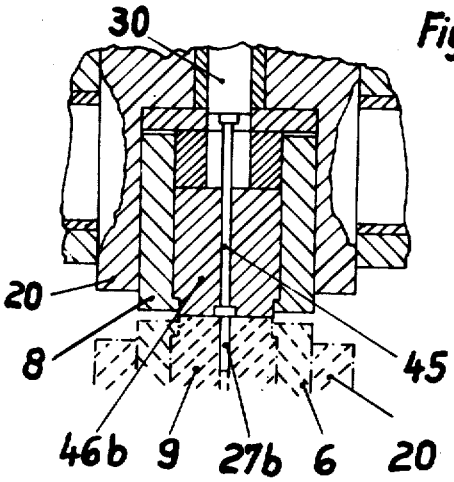
Figure 9:
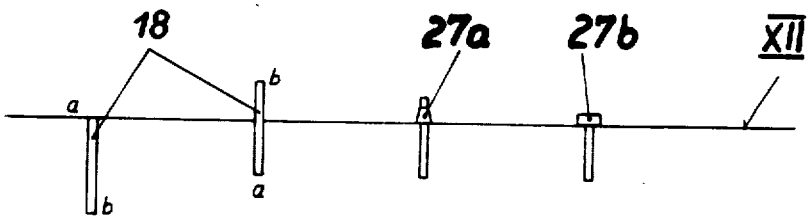

To obtain an advantageous relationship for the transmission of sheared-off blanks 18 into the rotary element 2, the shearing off of the blanks 18 from a continuous wire is carried out at a predetermined angle $\beta$ (FIG. 1), at which a stationary cutting tool, coordinated with corresponding cutting tools on the blank receiving members 5 of the rotary element 1, is displaced in direction of rotation of the rotary element 1 with respect to a horizontal plane passing through the axis of the rotary element 1. The blank receiving members 5, 6, 7 and 8 are each formed with a passage extending in substantial radial direction for receiving a blank and the members 5–8 being mounted on the respective rotary element tiltable about a tilting axis, that is the axis of a shaft 20 connected thereto, which tilting axis is radially outwardly spaced from and parallel to the axis of rotation of the respective rotary member, that is the axis of the shaft 19. The apparatus further includes means for tilting each blank receiving member through an angle $\alpha$ about the tilting axis to maintain the passages in a pair of cooperating rotary elements aligned with each other during rotation of the cooperating rotary elements through an angle $\alpha'$ with respect to each other. The control movement for tilting the blank receiving members about their respective tilting axes to obtain the angle $\beta$ (maximum 15°) and the tilting angle $\alpha$ (maximum 30°) at the shearing location and at the working stations I, II and III so that the radial passage in the blank receiving members 5-8 of corresponding cooperating rotary elements 1, 2; 2, 3; and 2, 4 will remain aligned with each other during rotation of the rotating elements through a certain angle, is produced by means of stationary double-cam curves 22 and a two-armed lever 23 fixedly connected to each of the shafts 20 and having on opposite ends thereof roller followers 24 cooperating with the cam curves 22. The wire blanks sheared off by the shearing tools are transmitted at the working station I from the rotary element 1 onto the rotary element 2 and are received in the latter between the matrices 9. The shafts 20 of the blank receiving members 5–8 for the rotary elements 1–4 are tiltably mounted in bearings 25 in the respective rotary elements, and each of the blank receiving members is of substantially cylindrical form and surrounded in part by a part-cylindrical thrust bearing 26, as best shown in FIG. 5, taking up the force applied thereto during pressing of the blank.

The apparatus includes further means cooperating with each of the blank receiving members for applying a force in radial outward direction on a blank received in the passage of the respective member during part of the movement of the respective member with the respective rotary element about the axis of the latter. The force applying means on the rotary element 1 serves to transfer sheared-off blanks from the passages of the blank receiving members 5 of the rotary element 1 into the passages of the members 6 of the central rotary element 2, and the force applying means on the central rotary element 2 serves to discharge the finished blanks from the passages or from between the matrices 9 of the blank receiving member 6 of the central rotary element 2, when a member 6 on the latter passes through a discharge zone IV displaced in the direction of rotation of the central rotary element 2 downstream of the rotary element 4. Corresponding force applying means are also coordinated with the blank receiving members 7 and 8 of the rotary elements 3 and 4 to maintain the blanks at the working stations II and III in a certain position relative to the cooperating rotary elements 2, 3 respectively 2, 4.

Figure 3:
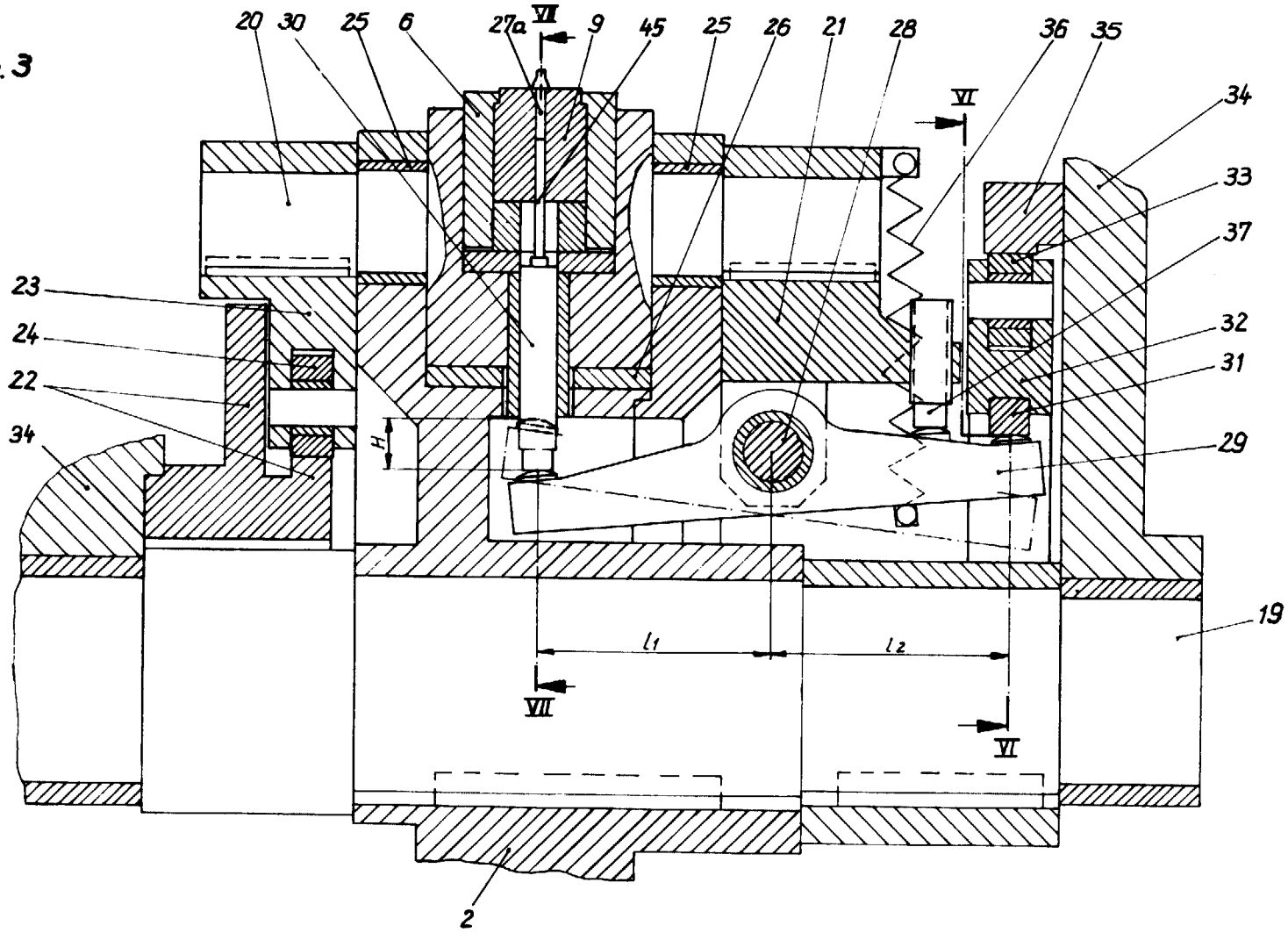
FIG. 3 is a cross-section taken along the line A—A of FIG. 1 and drawn to an enlarged scale.
Figure 4:
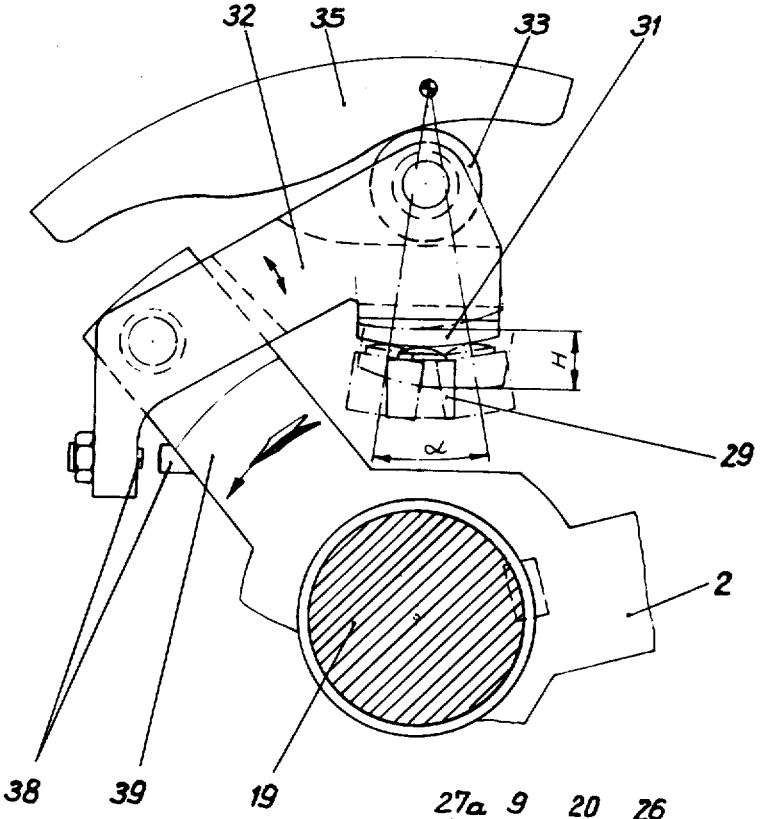
FIG. 4 is a cross-section taken along the line B—B of FIG. 3.

Each of the force applying means, respectively blank discharging means, comprise a tilting arm 21 fixed to each of the shafts 20 for tilting movement therewith and projecting with an end thereof from the axis of the shaft 20 toward the axis of the respective shaft 19, a double-armed lever 29 tiltably mounted on a pivot pin 28 on the free end of the tilting arm 21, a pushrod 30 axially movable in the passage of the respective member and engaged at one end thereof by one end of the double-armed lever 29 and adapted to engage with the other end thereof a blank 27 located in the respective passage, and an additional lever 32, carried by an arm 39 connected to the shaft 19 of the respective rotary element for rotation therewith, the additional lever 32 is mounted on the arm 39 for tilting about an axis spaced from and parallel to the tilting axis, that is the axis of the shaft 20. The additional lever 32 has an abutment portion 31 in engagement with the other end of the double-armed lever 29, and a roller follower 33 mounted on the additional lever 32 is in engagement with at least one additional stationary cam 35 provided for each of the rotary elements. (FIGS. 3, 4 and 5).

The number of blank receiving members 5, 6, 7 and 8 on the circumference of each of the rotary elements 1, 2, 3 and 4 will depend on the available space corresponding to the diameter of the rotary elements 1–4.

The tilting of the respective blank receiving members 5–8 occurs simultaneously with the tilting of the force applying means, respectively cooperating therewith, about the tilting angle $\alpha$, since the shaft 20, the two-arm lever 23, the blank receiving members 5–8 and the tilting arm 21 are connected with each other. During rotation of the rotary elements 1–4, the blank receiving members provided thereon will successively arrive at the transfer-, respectively forming-regions of the rotary element 1, respectively 3, 4. Finally finished screw blank 27 will arrive at the discharge zone IV of the rotary element 2, within which the above-described force applying means will discharge the finished screw blank 27 from the respective member 6 of the rotary element 2. Springs 36 respectively connected at opposite ends to the tilting arm 21 and to the double-armed lever 29 bias one arm of the latter against an adjustable abutment screw 37 and maintain the right end of the tilting arm 29, as viewed in FIG. 3, in engagement with the abutment 31 on the additional lever 32 to thereby tilt the double-armed lever 29 by means of the stationary cam 35 for the distance H, provided that the lever arms $l_1$ and $l_2$ are equal. An abutment 38 on the additional lever 32, respectively on the arm 39 on which the additional lever 32 is mounted, will prevent an undesired excessive tilting of the additional lever 32.

It will be understood that each of the elements described above, or two or more together, may also find a useful application in other types of apparatus for shearing blanks from elongated rod-shaped workpieces and for pressing such blanks into bolts or similar elements in a continuous operation differing from the types described above.

While the invention has been illustrated and described as embodied in an apparatus for shearing blanks from elongated rod-shaped workpieces and for pressing such blanks into bolts or similar elements in a continuous operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. Apparatus for shearing blanks from elongated rod-shaped workpieces and for pressing such blanks into bolts or similar configurations in a continuous operation, comprising a plurality of rotary elements arranged closely adjacent each other rotatable about parallel axes, each of said rotary elements being provided in the region of its periphery with blank receiving means, said rotary elements cooperating in pairs with each other and including a central rotary element, the blank receiving means of which are receiving blanks after the latter are sheared off and maintain said blanks during the pressing thereof until the finel discharge of the formed blanks, and a plurality of additional rotary elements arranged about the circumference of said central rotary element, one of said additional elements serving to shear blanks from the elongated rod-shaped workpieces and to transfer such blanks to the blank receiving means of the central rotary element, and at least two additional rotary elements for partly forming said blanks; drive means for rotating said rotary elements about their axes in such a manner that the rotary elements of cooperating pairs are respectively driven in opposite directions and so that the blank receiving means on one rotary element of each pair will become successively aligned with corresponding blank receiving means on the other rotary element of the respective pair; means coordinated with said blank receiving means of said one additional rotary elements for shearing blanks from elongated rod-shaped workpieces; and means coordinated with said blank receiving means of all rotary elements for applying axial forces to such blanks for transferring such blanks from said one additional rotary element to said central element, for applying opposite axial forces to said blanks as said blank receiving means on said central rotary element and the other additional rotary elements approach each other for pressing said blanks, and for discharging said blanks from the blank receiving means of said central element after pressing when said blank receiving means of said central element pass through a discharge zone displaced in the direction of rotation of said central element downstream of the last of said additional rotary elements.

2. Apparatus as defined in claim 1, and including a stationary shearing tool coordinated with said one additional rotary element located adjacent the periphery thereof and displaced in direction of rotation of said additional rotary element through a predetermined angle with respect to a horizontal plane passing through the axis of rotation of said one additional rotary element.

3. Apparatus as defined in claim 1, wherein each of said blank receiving means comprises a member formed with a passage extending in substantial radial direction for receiving a blank, said member being mounted in the respective rotary element tiltable about a tilting axis radially outwardly spaced from and parallel to the axis of the rotary elements and including means for tilting each member through a predetermined angle about said tilting axis to maintain the passages in a pair of cooperating rotary elements aligned with each other during rotation of the cooperating rotary element through a given angle with respect to each other.

4. Apparatus as defined in claim 3, wherein said means for tilting said members comprise a lever connected to each of said members for tilting movement therewith and having a pair of arms projecting to opposite sides of said tilting axis, a pair of stationary cams, and a pair of roller followers mounted on said arms and respectively engaging said cams.

5. Apparatus as defined in claim 3, wherein each of said members is cylindrical and including part-cylindrical thrust bearings for each cylindrical members in said rotary elements.

6. Apparatus as defined in claim 4, and including a shaft fixed to each of said members extending along said tilting axis, and bearing means for said shaft in each of the rotary elements, said lever being fixed to said shaft for tilting movement therewith.

7. Apparatus as defined in claim 3, wherein each of said force applying means comprises a tilting arm connected to the respective member for tilting therewith about said tilting axis and projecting with an end thereof from said tilting axis towards the axis of rotation of the respective rotary member, a double-armed lever tiltably mounted on said free end of said tilting arm, a pushrod axially movable in the passage of the respective member engaged at one end thereof by one end of the double-armed lever and adapted to engage with the other end thereof a blank located in said passage, and an additional lever connected to the respective rotary element for rotation therewith and for tilting about an axis spaced from and parallel to said tilting axis, said additional lever having an abutment portion in engagement with the other end of the double-armed lever, a roller follower mounted on said additional lever, and at least one additional stationary cam for each of said rotary elements engaged by said roller follower on said additional lever.

* * * * *